US006527400B2

(12) United States Patent
Dickie et al.

(10) Patent No.: US 6,527,400 B2
(45) Date of Patent: Mar. 4, 2003

(54) ELECTROLUMINESCENT SUPPLEMENTARY-LIGHTING DEVICE HAVING THREE-DIMENSIONAL CONFIGURATION

(75) Inventors: Robert G. Dickie, Newmarket (CA); Kirkwood Tierney, R.R. #1, Schomberg, Ontario (CA), L0G 1T0

(73) Assignee: Kirkwood Tierney, King City (CA)

( * ) Notice: Subject to any disclaimer, the term of this patent is extended or adjusted under 35 U.S.C. 154(b) by 0 days.

(21) Appl. No.: 09/845,261

(22) Filed: May 1, 2001

(65) Prior Publication Data

US 2002/0163796 A1 Nov. 7, 2002

(51) Int. Cl.[7] ..... H05B 33/12

(52) U.S. Cl. ..... 362/84; 362/226; 362/311; 362/95

(58) Field of Search ..... 362/84, 226, 311, 362/351, 95; 313/483, 512

(56) References Cited

U.S. PATENT DOCUMENTS

| | | | |
|---|---|---|---|
| 3,307,030 | A | 2/1967 | De Francisco |
| 4,138,620 | A | 2/1979 | Dickson |
| 4,774,641 | A | 9/1988 | Rice |
| 4,864,473 | A | 9/1989 | Tokarz et al. |
| D352,564 | S | 11/1994 | Marischen |
| 5,662,408 | A | 9/1997 | Marischen |

FOREIGN PATENT DOCUMENTS

| | | |
|---|---|---|
| EP | 0 818 793 | 1/1998 |
| EP | 0 917 409 | 5/1999 |
| EP | 0 969 699 | 1/2000 |
| WO | 98 57525 | 12/1998 |

*Primary Examiner*—Sandra O'Shea
*Assistant Examiner*—Guiyoung Lee

(57) ABSTRACT

An electroluminescent supplementary lighting device having three-dimensional configuration will typically have a curved front face, or a partial conical front face; or have the configuration of a truncated pyramid. The entire front face is light emitting when the device is plugged into a wall receptacle. The front face is translucent, and an electroluminescent panel having substantially the same configuration as the front face underlies the front face within the attached interior of the lighting device. A connection tab extends from an edge of the electroluminescent panel into an enclosed volume within the lighting device, where connections are made to electrical prongs so as to provide a voltage across the electroluminescent phosphor lying within the electroluminescent panel between the electrically conductive front and back sheets.

20 Claims, 7 Drawing Sheets

ELECTROLUMINESCENT SUPPLEMENTARY-LIGHTING DEVICE HAVING THREE-DIMENSIONAL CONFIGURATION

FIELD OF THE INVENTION

This invention relates to supplementary lighting devices, specifically electroluminescent supplementary lighting devices which have a non-planar "three-dimensional" configuration. The configuration of the present invention permits substantially the entire front face of the device to emit light.

BACKGROUND OF THE INVENTION

The use of supplementary lighting devices, particularly as night lights, has been well known for a considerable period of time. Typically, supplementary lighting devices are employed so as to provide illumination in a darkened hallway, illumination in bathrooms, or in children's and infants' bedrooms and the like, without the necessity to turn on the primary lighting. While other purposes for the present invention may be found in aisles of public conveyances and venues such as airplanes, buses, theatres, and the like, the present discussion is particularly directed to night lights, because that is the most common embodiment.

Night lights, as their name suggests, find their usefulness when it is dark. They typically plug into an AC wall receptacle, where they will reside for a lengthy period of time. Prior art devices such as night lights are typically found in one of several categories.

One category utilizes incandescent lamp technology, which is relatively bright, and is economical to manufacture. Typically these kinds of night lights need an "on/off" switch; often an automatic one which functions under control of a light sensing device such as a light sensitive resistor or diode. The cost of replacement of incandescent bulbs in the socket of such night lights is relatively low, as is their initial cost.

However, incandescents have several other disadvantages. For instance, they tend to have a short life with a relatively-high power consumption and a low efficiency of about 10%. Also, incandescent night lights tend to be a bright point-source light, so that their light output is relatively obtrusive. Moreover, since they generate light via heat by having a filament temperature of about 2500° C., and since in small-format bulbs that filament is extremely close to the glass envelope, incandescent-style night-lights have dangerously hot bulb surfaces. Indeed, the inadvertent placement of such as a blanket or paper over the night light could result either in melting of the plastic housing of the night light or, worse, fire.

Another category of night light uses neon bulb technology, which has relatively low initial cost and very low power consumption, but which has a very low, typically red-coloured light and a rapid decay in their light output. Such weak light output as there is also tends to be seen as a point source, but provides little significant illumination of even the closely-adjacent area.

Fluorescent lighting devices are also used as night lights, but they tend to be expensive, requiring special circuitry to initiate their illumination and to then maintain their operation economically. They are very bright, but often too bright for many applications.

Finally, electroluminescent night lights have become popular because of several significant advantages. One advantage is that they have a broad light output area, so that they are not a point source and therefore less obtrusive. Also, they are very energy-efficient devices, so economical that they can be plugged in and essentially forgotten for their working life. Also, because of their light-generating technology they are cool to the touch. Furthermore, electroluminescent lighting devices have a reasonably long life.

A particular embodiment of night light is described hereafter with reference to a patent and design patent which defines that night light. However, for purposes of the present discussion, it can simply be stated that a typical electroluminescent night light has an appearance which is not unlike the front face of a television set in some respects, in that comprises a window which is set into a planar front face, with a significant frame around and particularly below the window. The window is set into the front face, and an electroluminescent panel resides behind that window. Typically, the electroluminescent panel has a green glow. A pair of electrical prongs extends from the back surface of the panel, in a region below the window and on the opposite face—the back face—of the night light housing.

Prior art electroluminescent night lights have some disadvantages. For instance, because they typically comprise a flat panel, their illumination is primarily directed perpendicularly from their face. The electroluminescent panel may illuminate somewhat to the sides, but it is limited illumination because the electroluminescent panel set well back behind the front face window.

Furthermore, the amount of light which can be generated through the window is not great, since they do not provide a large surface area for an electroluminescent panel, being limited by mechanical interference from the electrical blades and often by the need to restrict the size to one-half of a wall outlet. Since this restricts the window size to a fraction of the overall lamp size, their decor may not be optimal.

Another disadvantage is that despite the considerable child-safety benefit of cool electroluminescent light, there exist some additional child-safety drawbacks in the current art. Since night lights are very frequently used in nursery environments, these deficiencies are of special concern. For example, flat panel electroluminescent lighting devices may present a safety or electrical shock hazard because the electrical prongs of the device are exposed behind the device. But also, since some infants, particularly crawlers and toddlers, may well put anything they find into their mouth, there is a risk that saliva from the infant's mouth may run down the front of the window and into the panel structure where it may contact the inner ends of the electrical prongs or the electrical wires which connect them to the opposed sides of the electroluminescent panel, causing a significant electrical shock hazard to the infant, as well as blowing a fuse or tripping a circuit interrupter.

All of the advantages, but none of the disadvantages, of prior art electroluminescent supplementary lighting devices, as discussed above, are found in electroluminescent supplementary lighting device of the present invention.

In particular, the present invention provides an electroluminescent supplementary lighting device which has a multi-planar "three-dimensional configuration", as compared to the primarily mono-planar prior art. The three-dimensional configuration gives further several advantages. They include:

Firstly, an important part of the electrical shock hazard of the prior art devices is overcome because the electroluminescent panel is completely enclosed behind a large lens piece which can be completely attached in a water-proof manner. This eliminates an important source of electrical shock hazard to infants. Also, the increased cavity area around the prongs allows special child-safety electrical-prong shields to be incorporated, which eliminates the other important source of concern.

Furthermore, electroluminescent supplementary lighting devices in keeping with the present invention are more easily adapted to provide certain international AC-blade forms which have a greater need for body depth.

In addition, electroluminescent supplementary lighting devices in keeping with the present invention have better dispersion of light in directions other than more or less perpendicular to the AC wall outlet. This is because the multi-planar front face plate emits light in many more directions.

Further, since substantially the entire front face of the present invention is light emitting. They are much more visible, and provide considerably greater illumination to the immediately surrounding area. There are also some decor advantages which evidence themselves from a fully-lit design style, since electroluminescent supplementary lighting devices, in keeping with the present invention are effectively both "frameless" in appearance, and also since there are various possible three-dimensional configurations, they present more opportunities to have a shape which may be more pleasing and acceptable, from an aesthetic point of view, to a broader cross-section of the population.

DESCRIPTION OF THE PRIOR ART

A plug-in electroluminescent lighting device is known from DE FRANCISCO U.S. Pat. No. 3,307,030 issued Feb. 28, 1967. This device employs a mono-planar electroluminescent element mounted on such as a glass foundation or structure, and which is put into place to serve as the cover or wall plate for a wall receptacle or wall-mounted switch. Thus, this device shows the fundamental design features of current electroluminescent nightlight designs, prior to the ready availability of flexible-plastic electroluminescent panels. Such electroluminescent devices as were depicted by De Franciso were expensive to produce, prospectively fragile when not in place, and expensive to replace.

DICKSON U.S. Pat. No. 4,138,620 issued Feb. 6, 1979 provides a multi-panel mono-planar electroluminescent panel assembly which comprises a plurality of uniformly illuminated overlapping electroluminescent panels. Their purpose is to provide a graphic advertising or signboard display which is essentially back-lit by electroluminescent panels, and which has a substantially flat structure.

TOKARZ et al. U.S. Pat. No. 4,864,473 issued Sep. 5, 1989, provides an electroluminescent dome light which is intended particularly to be placed into a convertible automobile vehicle. Its purpose is to provide a quick high light output by being mounted in a convenient place within the convertible automobile, and to take the place of a roof-mounted dome light which, of course, is not found in a convertible automobile.

MARISCHEN was granted U.S. Design patent No. DES 352,564 which issued Nov. 15, 1994 and U.S. Pat. No. 5,662,408 which issued Sep. 2, 1997, each directed to a low profile, mono-planar, electroluminescent night light. It is to the widely-used Marischen-style night lights and to others of its same general appearance and construction, that many of the above comments have been directed, as to the disadvantages thereof.

SUMMARY OF THE INVENTION

In accordance with one aspect of the present invention, there is provided an electroluminescent supplementary light device which has a multi-planar three-dimensional configuration. The device comprises an electroluminescent panel and a housing within which the electroluminescent panel is located.

The electroluminescent panel is such that its construction includes front and back electrically conductive layers with an electroluminescent phosphor layer and a dielectric layer disposed therebetween.

A housing is provided, having a substantially planar rear wall through which a pair of electrical prongs protrude for placement into mating slots of an AC power receptacle.

A translucent front face protrudes forwardly away from the substantially planar rear wall, so as to define an enclosed volume between the substantially planar rear wall and the front face.

The electrical prongs extend through the substantially planar rear wall and into the enclosed volume.

In any embodiment of the present invention, the electroluminescent panel has a predetermined shape. At least one electrical connection to each of the front and back electrically conductive layers is made.

Electrically conductive leads extend away from the electrical connection for each of the front and back electrically conductive layers, and the electrically conductive leads have sufficient length and flexibility so that they extend into the enclosed volume for electrical connection to the electrical prongs within the enclosed volume.

The translucent front face has edges which terminate at the edges of the substantially planar rear wall, and adjacent edges of the translucent front face and of the substantially planar rear wall are attached one to the other.

The electroluminescent panel is configured so that at least one side edge is placed in the region where an edge of the translucent front face is attached to an edge of the substantially planar rear wall.

The electroluminescent panel protrudes forwardly away from the at least one side edge so as to be contiguous to at least a major portion of the translucent front face.

A particular embodiment of the electroluminescent supplementary lighting device of the present invention has the translucent front face configured so as to curve forwardly from a pair of opposed side edges of the substantially planar rear wall so as to thereby define the enclosed volume so as to be forward of the substantially planar rear wall, behind the curved translucent front face and between upper and lower edges thereof.

The substantially planar rear wall has four side edges to which the translucent face can be respectively attached; and the electroluminescent panel is configured as a partial cylinder by arching a rectangular two-dimensional panel so that two opposed sides of the electroluminescent panel form an arch which corresponds to the arch of the curved translucent front face.

Another embodiment of the present invention, which is a variant of the partially cylindrical configuration, has upper and lower faces which extend rearwardly from the upper and lower edges of the curved translucent front face to the substantially planar rear wall, and the upper and lower faces each comprise an electroluminescent panel.

In a further variant of the partially cylindrical configuration, the electroluminescent supplementary lighting device of the present invention has the translucent front face configured so as to curve forwardly such that the radius of curvature of the curved shape at one of the upper and lower edges is different from the radius of curvature at the other of the upper and lower edges. This defines a partial truncated conic enclosed volume forward of the substantially planar rear wall, behind the curved translucent front face. The substantially planar rear wall has four side edges which form a trapezoid to which the translucent face is attached.

Another variation of the electroluminescent supplementary lighting device of the present invention is such that the translucent face has a configuration of a truncated pyramid, comprising a rectangular top surface and four side surfaces sloping downwardly therefrom.

In this embodiment, the substantially planar rear wall has four side edges to which the translucent face can be respectively attached.

The configuration is such that the truncated pyramid comprises a rectangular top surface and four side surfaces sloping downwardly therefrom, such that each of the side surfaces has a trapezoidal shape.

Each of side surfaces of the electroluminescent panel is separated from the adjacent ones of the side surfaces; and the top edges of each of the side surfaces are contiguous to and electrically connected with the rectangular top surface at the respective front and back electrically conductive layers of each.

Thus, the electroluminescent panel is disposed so as to nestle within the enclosed volume between the translucent face and the substantially planar rear wall, so that each of the side surfaces of the translucent face rests adjacent and above a corresponding one of the side surfaces of the electroluminescent panel.

In the truncated pyramid embodiment, of the electroluminescent supplementary lighting device of the present invention, one of the surfaces of each of the translucent front face and of the electroluminescent panel is square.

In any embodiment of the electroluminescent supplementary lighting device of the present invention, the connection to each of the front and back electrically conductive layers is made at the at least one side edge by connectors which are chosen from the group consisting of a pair of staples connected one to each of the respective electrically conductive layers, a pair of electrically conductive terminal pads secured one to each of the respective electrically conductive layers, and a pair of electrically conductive clips attached one to each of the respective electrically conductive layers.

In any connection according to the present invention, a pair of wires extends from the connectors into the enclosed volume through which an electrical connection is made between each of the connectors and a respective one of the electrical prongs.

Also, in any embodiment of the electroluminescent supplementary lighting device of the present invention, a connection tab may extend from the at least one side edge. In that case, the connection tab includes electrically conductive extensions of each of the front and back electrically conductive layers; and a pair of connection terminals extends away from the connection tab, one for each of the front and back electrically conductive layers, and is electrically insulated one from the other.

An electrical connection is made between each of the connection terminals and a respective one of the electrical prongs; and the connection tab is folded from the at least one side edge of the electroluminescent panel so as to extend there behind into the enclosed volume.

Still further, in any embodiment of the electroluminescent supplementary lighting device of the present invention, the size of the electroluminescent panel is such that the electroluminescent panel will fit snugly to the interior surface of the translucent front face.

Also. In any embodiment of the electroluminescent supplementary lighting device of the present invention, the side edges of the translucent face are attached to the side edges of the substantially planar rear wall by sealing means which are chosen from the group consisting of ultrasonic welding, mutually compatible solvents, adhesives, double-sided adhesive tapes, overlaid adhesive tapes, snapping adjacent edges together, and mixtures thereof.

Other embodiments of the present invention are as described above, except that the edges of the translucent front face do not terminate at the edges of the substantially planar rear wall, but they terminate at some intermediate position inwardly of the edges of the substantially planar rear wall but on the substantially planar rear wall.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of. the present invention, as to its structure, organization, use and method of operation, together with further objectives and advantages thereof, will be better understood from the following discussion.

Before discussing the specific details of any embodiment of the present invention, it will be noted that the present invention provides an electroluminescent supplementary lighting device. It is well known, to those skilled in the art of electroluminescent panel design, that any electroluminescent panel of the sort which finds utility in electroluminescent supplementary lighting devices of the type described herein will typically be comprised of a sandwich-type construction consisting of flexible front and back outer plastic non-conductor layers covered on their inner surfaces with electrically conductive layers which have on their inner layers an electroluminescent phosphor layer and a dielectric layer disposed therebetween. However, the precise layer structure of electroluminescent panels is beyond the scope of the present invention.

Figure 1:
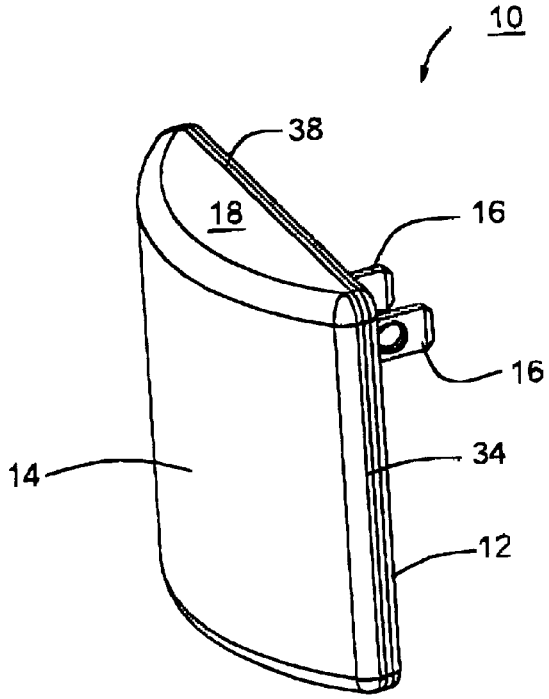
FIG. 1 is a perspective view of a first embodiment of an electroluminescent supplementary lighting device, in keeping with the present invention, seen from the front.
Figure 3:
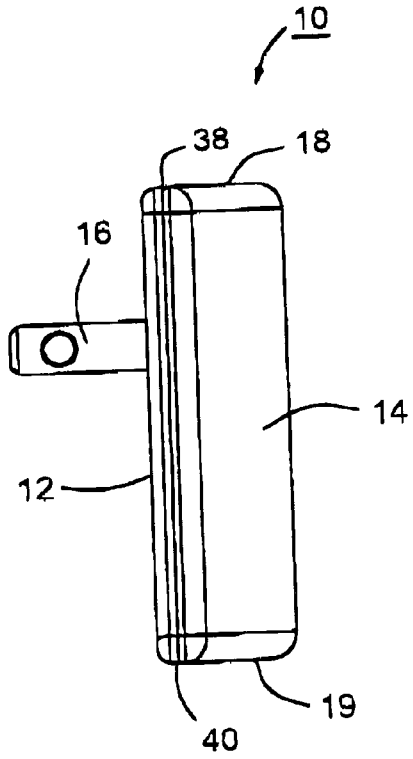
FIG. 3 is a side elevation of the embodiment of FIG. 1.
Figure 4:
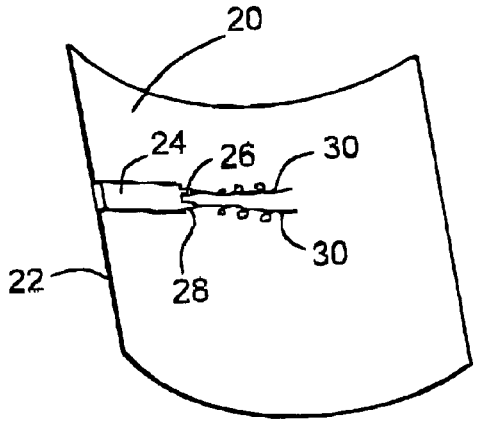
FIG. 4 is a perspective view of an electroluminescent panel which is the light emitting element of the embodiment of FIG. 1.
Figure 5:
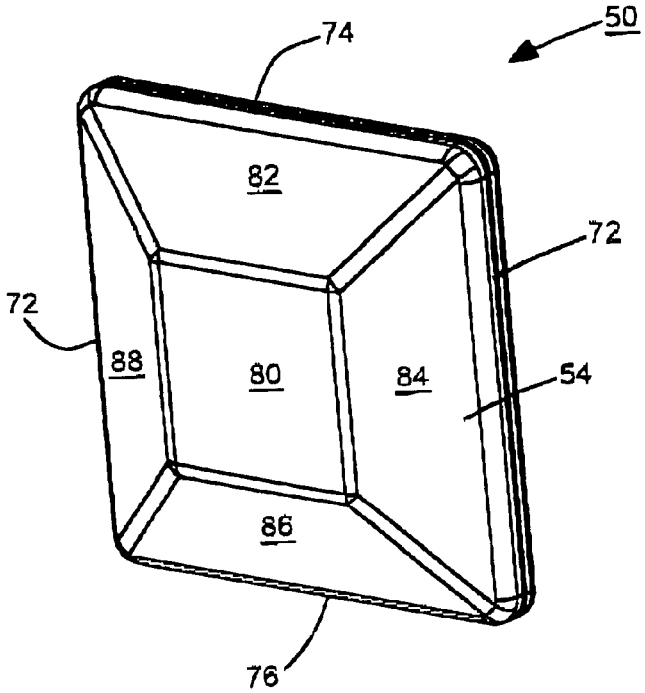
FIG. 5 is a perspective view of a second embodiment of electroluminescent supplementary lighting device in keeping with the present invention, seen from the front.
Figure 9:
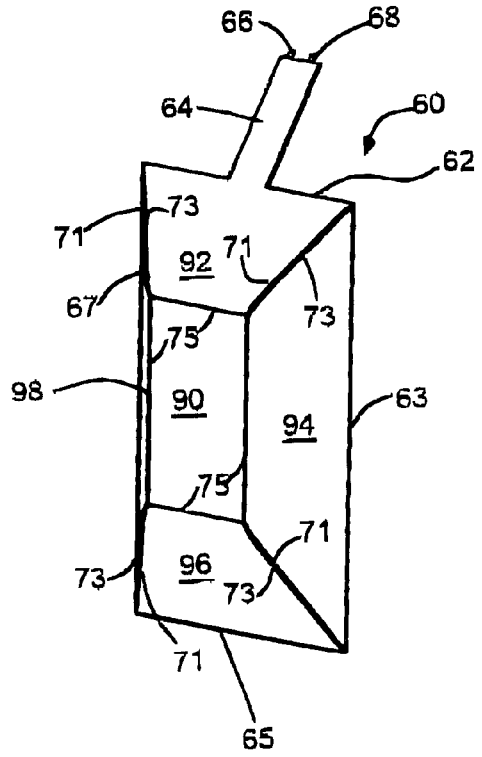
FIG. 9 is a perspective view of the electroluminescent panel as it is employed in the embodiment of FIG. 5, when partially configured for use in that embodiment.
Figure 10:
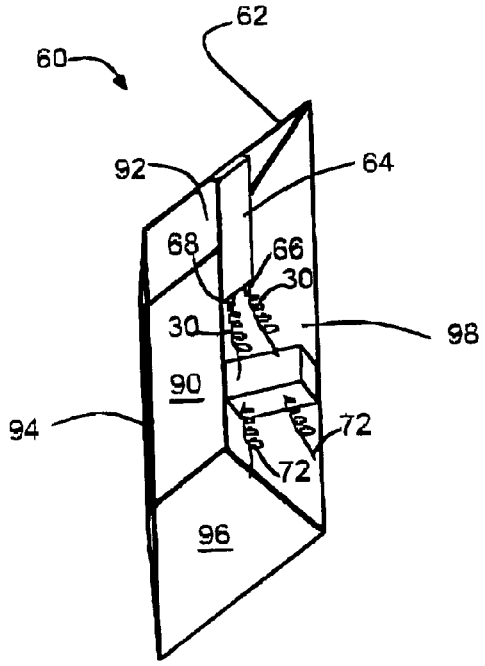
FIG. 10 is a perspective view of the electroluminescent panel of the embodiment of FIG. 5, configured for use.
Figure 11:
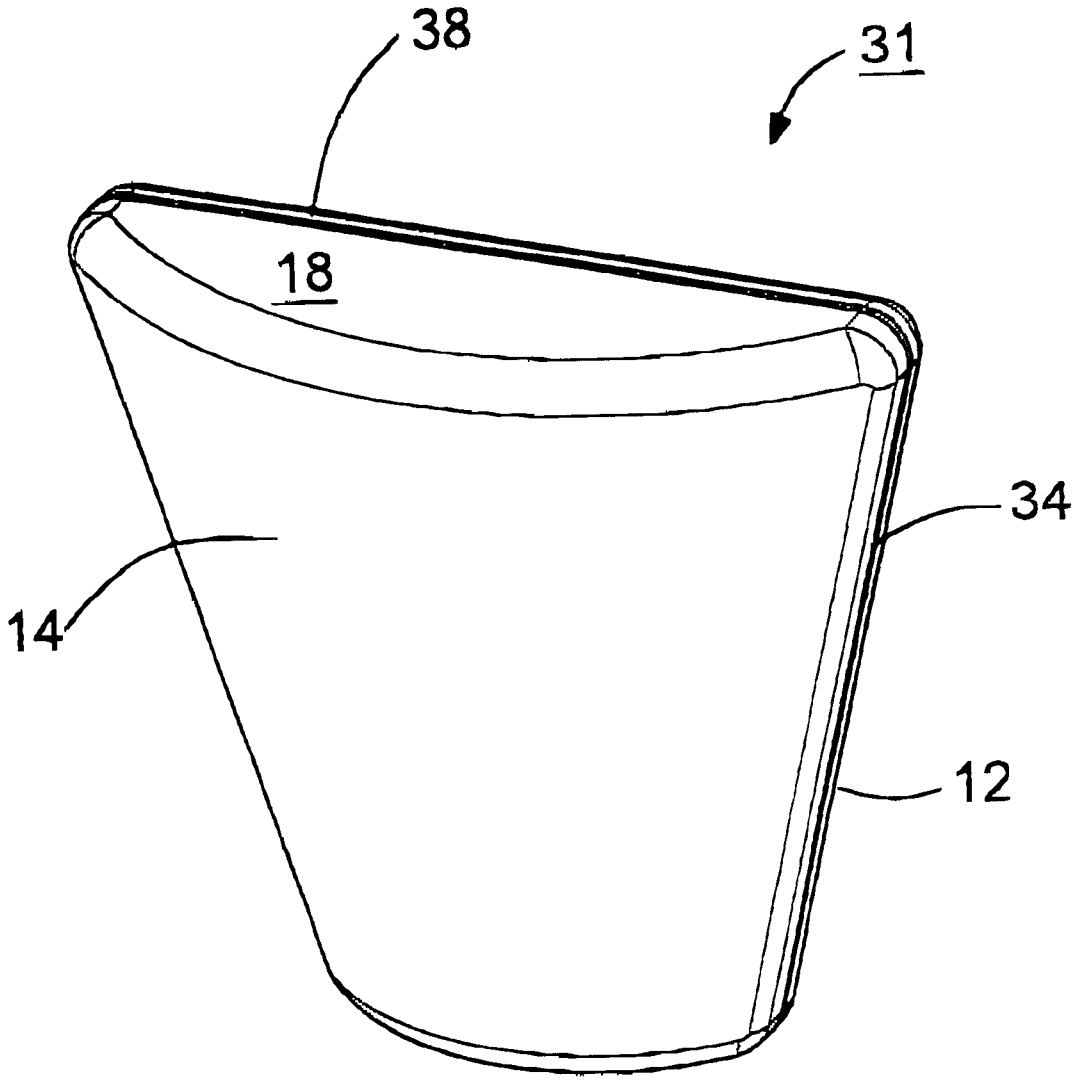
FIG. 11 is a view similar to FIG. 1 of a further embodiment of an electroluminescent supplementary lighting device in keeping with the present invention, having a partial conic configuration.

In the present invention, the electroluminescent panel, which is normally manufactured in a two-dimensional configuration, now has an alternate three-dimensional configuration, Such configurations are shown, for example, in FIGS. 1, 5, and 11; with the embodiments being shown in various particulars in FIGS. 1 through 4, 5 through 10, and 11 and 12 respectively.

The principal components of the electroluminescent supplementary lighting device of the present invention are an electroluminescent panel, having a predetermined shape and commonly having a connection tab at one edge thereof; and a housing piece which comprises a substantially planar rear wall, and a translucent front face piece which protrudes forwardly away from the planar rear wall. A pair of electrical prongs protrude through the planar rear wall. Like elements in any of the embodiments described in FIGS. 1 through 4, and 5 through 12, will be seen to have the same reference numerals in the following discussions; whereas specifically configured elements for each embodiment of the present invention will have their own reference numerals.

Figure 2:
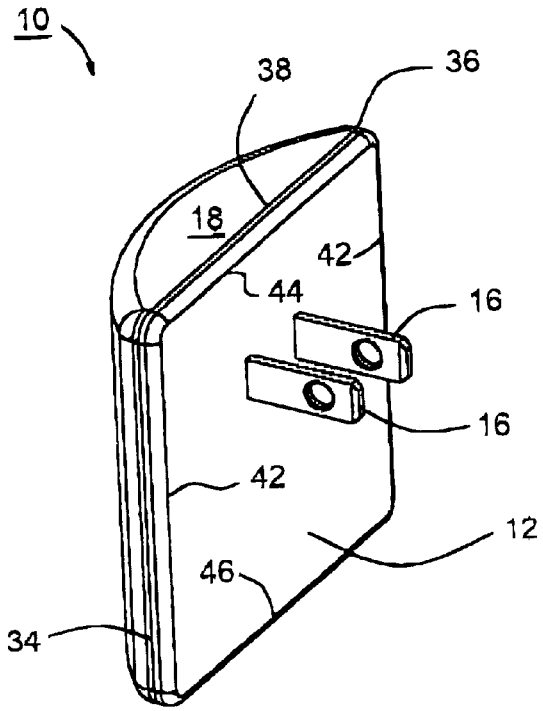
FIG. 2 is a perspective view of the embodiment of FIG. 1, seen from the rear.
Figure 6:
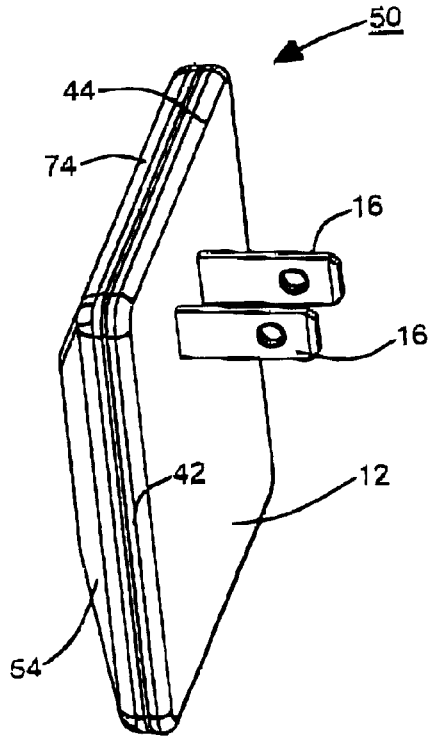
FIG. 6 is a perspective view of the embodiment of FIG. 5, seen from the rear.
Figure 7:
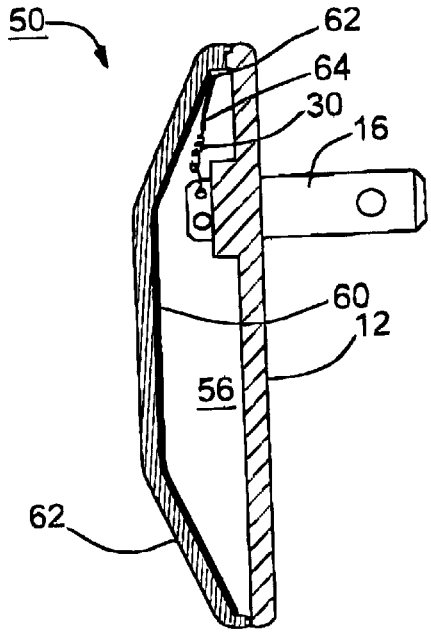
FIG. 7 is a side cross-sectional view of the embodiment of FIG. 5.
Figure 12:
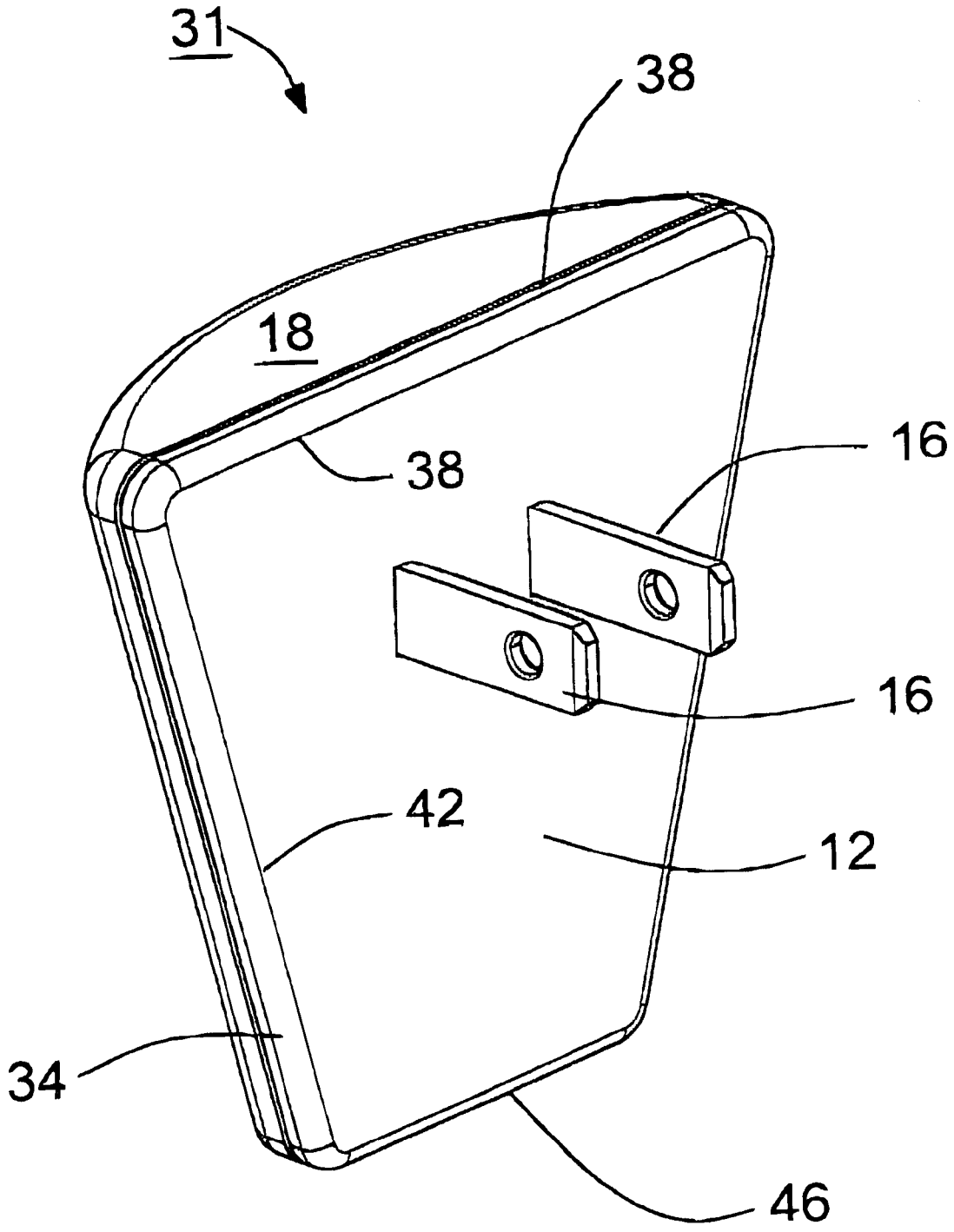
FIG. 12 is a view similar to FIG. 2, of the embodiment of FIG. 11.

Typical embodiments of the present invention are shown at 10 in FIGS. 1, 2, and 3; at 50 in FIGS. 5, 6, and 7; and at 31 in FIGS. 11 and 12. Embodiment 10 comprises a housing which has a substantially planar rear wall 12, and a translucent front face 14. Embodiment 31 is a partial conical configuration variant of embodiment 10, and also has a translucent front face 14. Embodiment 50 comprises a substantially planar rear wall 12, and a translucent front face 54. Each of embodiments 10 and 50 includes a pair of electrical prongs 16 which protrudes through the planar rear wall for placement into mating slots of an AC wall receptacle which has household voltage imposed between the mating slots thereof. Accordingly, household voltage will be imposed between the electrical prongs 16; and, as noted hereafter, household voltage will be imposed across the electroluminescent panel, possibly via an intervening electronic control circuit 70 as shown in FIG. 10.

In any embodiment 10, 50 or 31, the translucent front face 14 or 54 protrudes forwardly away from the planar rear wall 12, so as to define an enclosed volume within the housing. The enclosed volume within the housing of embodiments 10 and 31 will be understood from an examination of FIGS. 1 through 3; the enclosed volume within the embodiment 50 is more the specifically depicted as enclosed volume 56 in FIG. 7.

Also in FIG. 7, it can be seen that the electrical prongs 16 extend through the planar rear wall 12 into said enclosed volume. Thus, electrical connection between the electroluminescent panel and the electrical prongs 16 can easily made within said enclosed volume, in a manner described hereafter.

Each electroluminescent panel has a predetermined two-dimensional shape which can be bent or otherwise configured into a predetermined three-dimensional shape. Thus, electroluminescent panel 20, shown in FIG. 4, which would normally be manufactured as a two-dimensional flat rectangle, can also have a generally curved three-dimensional shape, as will be discussed hereafter. Likewise, the flat electroluminescent panel 60, shown in FIG. 8, can take the three-dimensional configuration of a truncated pyramid 62, shown in each of FIG. 9, and as discussed hereinafter.

Figure 8:
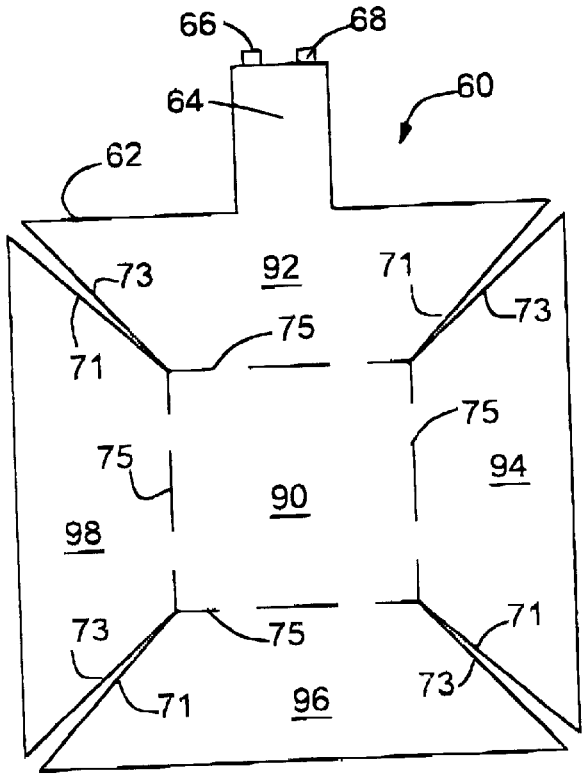
FIG. 8 is a plan view of the electroluminescent panel employed in the embodiment of FIG. 5.

Referring now to FIGS. 4 and 8, each electroluminescent panel 20 or 60 has at least one side edge 22 or 62, at which electrical connections are made to each of the front and back electrically conductive layers within the electroluminescent panel 20 or 60.

Typically, the electrical connections are made via a connection tab 24 or 64, as described hereafter, from which electrically conductive leads extend into the enclosed volume behind the respective electroluminescent panel 20 or 60. Such leads will have sufficient length and flexibility to connect directly or indirectly—through intervening electronic circuitry 70 as discussed hereafter—to the electrical prongs 16. It will also be evident to one skilled in the art of common design practice for electroluminescent panels, that electrical connection points can indeed be created at almost any location on the panel; and it will also be evident that more than one pair of connection points can be created for said panels.

If the electrical connections are made right at the side edges 22 or 62, there may be an area at that side edge in the region of the electrical connection where, of course, there may be no local electroluminescence because the structure of the electroluminescent panel will have had to be altered at the connection region so as to permit electrical connections for each of the front and back electrically conductive layers. For this reason, tab extensions of the material are common.

Such electrical connections may be via a pair of staple-pins which are connected to the respective electrically conductive layers. Other connections, which may be made to the respective electrically conductive front and back layers of the electroluminescent panels 20 or 60, may be via a pair of electrically conductive terminal pads—essentially, conductive traces or pads—which are secured one to each of the respective electrically conductive layers, or via a pair of electrically conductive clips which are attached on to each of the respective electrically conductive layers.

Each of the connection tabs 24 or 64 comprises connecting terminals 26, 28 and 66, 68, respectively, which are arranged at the ends of the respective connecting tabs 24 and 64. Each of the connecting terminals 26 and 28 is connected to a respective one of the front and back electrically conductive layers of the electroluminescent panel 20; and, likewise, each of the connecting terminals 66 and 68 is connected to a respective one of the front and back electrically conductive layers of the electroluminescent panel 60.

The connecting terminals are arranged for electrical connection to a respective one of the electrical prongs 16, such as via wires 30 shown in FIG. 4; or via wires 30 through an electronic control circuit 70 and then via wires or circuit-board paths 72 to electrical prongs 16, as shown in FIG. 10.

The electronic control circuit 70 may be such as to provide electrical power of a different voltage than household AC voltage, or to provide a defined wave shape to the electroluminescent panel 60 (or 20), or to provide an electromechanical on/off switch, or to provide an electro-optical "daytime off" switch or other such common light control functions. The particulars of such an electronic control circuit 70, if used, are beyond the scope of the present invention.

It will be noted, however, that all of the connections including wires 30, and electronic control circuit 70 and wires 72, if necessary, are found within the enclosed volume which is defined between the planar rear wall 12 and the respective front faces 14 or 54 of the embodiments 10 or 50, respectively.

As will be seen in each of FIGS. 4 and 10, the respective connection tab 24 or 64 is curved or folded from the respective side edge 22 or 62 of the respective electroluminescent panel 20 or 60, so as to extend behind the electroluminescent panel 20 or 60 into the enclosed volume. Accordingly, as noted above, there is no risk of electrical shock hazard existing, with respect to access to the connecting terminals 26, 28 or 66, 68, because any access thereto can only be provided if the respective night light 10 or 50 has been removed from a wall receptacle.

Each of the translucent front faces 14 and 54 has edges which terminate at the edges of the planar rear wall 12. For example, referring now to FIGS. 1 and 2, front face 14 has side edge 34 which terminates at respective side edge 42, and opposed top and bottom edges 38 and 40 which terminate at opposed top and bottom edges 44 and 46 of the substantially planar rear face 12. Adjacent edges of the translucent front face 14 and the planar rear wall 12 are attached one to the other.

Referring now to FIGS. 5 and 6, the same arrangement holds true with respect to the embodiment 50, where edges 72, 74 and 76, are attached to the respective edges 42, 44 and 46, of the planar rear wall 12.

In each of embodiments 10 and 50, the respective electroluminescent panel 20,and 60 is configured so that at least the side 22 or 62 is placed in the region where an edge of the front face is attached to an edge of the planar rear wall. Thus, the edge 22 of panel 20 is placed where an edge 34 of the translucent front face 14 is attached at edge 42 of the planar rear wall 12 of the embodiment of FIGS. 1 through 4.

Typically, as is seen in FIGS. 6 and 7, it will be noted that, in the embodiments shown, the electrical prongs 16 are placed nearer the top of the respective embodiments than the centre. This may be required according to some electrical codes; so that, when an electroluminescent supplementary lighting device in keeping with the present invention is placed into the top outlet of a standard two outlet AC wall receptacle, the bottom outlet will be covered.

As can be inferred from an examination of FIG. 4, and as is shown in FIG. 7, the respective electroluminescent panels 20 or 60 will protrude forwardly away from their respective side edges 22 or 62 so as to be contiguous to at least a major portion of the translucent front face 14 or 54. However, it must be noted that the electroluminescent panels 20 or 60 are not, themselves, necessarily attached in place. Rather, their three-dimensional configuration and the elastic or spring memory of the materials which comprise electroluminescent panels 20 and 60, can assure that they remain in place within the enclosed volume and proximate the respective front face 14 or 54.

With regard particularly to the configuration of FIGS. 1 through 4, having a curved translucent front face 14, the curve is typically from side-to-side, but might be from top-to-bottom. The curved electroluminescent panel is placed behind the curved translucent front face 14; it being noted that the construction of most commercially available electroluminescent panels is such that a gentle curve may be imposed in them. Also, the construction of commercially available electroluminescent panels is such that they may be bent in a relatively tight radius so as to configure the connection tabs 24 or 64 without destroying the electrical continuity of either of the electrically conductive front or back sheets thereof.

The embodiment of FIGS. 1 through 4, as seen in FIGS. 1 through 3 in particular, will also comprise top and bottom portions 18 and 19, so that the enclosed volume within the embodiment 10 is defined as being behind the curved front face 14 and in front of the planar rear face 12, and between the top and bottom cover portions 18 and 19.

Typically, the top and bottom cover portions 18 and 19 are opaque, so that light emitted from the embodiment 10 is emitted through the curved translucent front face 14 only. However, those portions 18 and 19 may also each comprise an electroluminescent panel, so that nearly the entire structure forward of the substantially planar rear face 12 exhibits electroluminesence.

Referring to the embodiment 50 shown in FIGS. 5 through 10, it will be noted that that configuration is essentially that of a truncated pyramid. The translucent face 54 comprises a rectangular top surface facet 80, and also four side surface facets 82, 84, 86, and 88 which slope downwardly—that is, rearwardly—from the rectangular top surface 80. Each of the side surfaces 82, 84, 86, 88 terminates at one of the pair of respective side edges 72, or at one of the pair of opposed top and bottom edges 74 and 76.

As previously noted, the side edges and opposed top and bottom edges 42, 44, and 46, respectively, of the planar rear wall 12 are attached to the respective side edges 72 and the respective top and bottom edges 74, 76, of the translucent front face 54.

The electroluminescent panel 60 is also configured as a truncated pyramid, as can be seen particularly in FIGS. 7, 9, and 10. It also comprises a rectangular top surface facet 90 and four side surface facets 92, 94, 96, 98, which slope downwardly—that is, rearwardly—when in place as shown in FIG. 7, from the top surface 90. Each of the side surface facets 92, 94, 96, 98, terminates at a respective side edge or one of pair of opposed top and bottom edges 63, 67, and 62, 65, respectively.

As can be seen in FIGS. 8 through 10, each of the side surfaces of the electroluminescent panel 60 has a trapezoidal shape which has a base at one of edges 62, 63, 65, or 67, and a pair of trapezoid edges 71, 73, and a top ends 75. Of course, it also follows that there is electrical continuity at the top edges 75 of each of the side surfaces 92, 94, 96, 98 with the top surface facet 90, and thus, when power is applied to the electroluminescent panel through the connecting terminals 66 and 68, each facet will be light emitting.

Another embodiment of the truncated pyramid configuration of the electroluminescent panel 60 of the present invention takes advantage of the fact that, if the front and back electrically conductive layers of the electroluminescent panel are each covered with an insulative layer, then one of the pair of trapezoid edges 71 or each of the side surface facets 92, 94, 96, 98 will slightly overlie the opposite trapezoid edge 73 of an adjacent one of the four side surface facets 92, 94, 96, 98. Of course, it may be that sides 73 will overlie sides 71. This will assure that there are no apparent dark lines as might appear otherwise at the regions where the trapezoid side edges are adjacent one another, and therefore assures an apparent light emitting panel having a three-dimensional configuration.

Typically, as noted, the top surface facets 80 and 90 of the translucent front face 54 and the electroluminescent panel 60, respectively, are square.

Of course, the size of the electroluminescent panel 60 is such that, when it is placed in the embodiment 50, the electroluminescent panel 60 will fit snugly to the inside surface of the translucent front face 54, as seen in FIG. 7.

The manner in which either of the translucent front panels 14 or 54 may be attached to the planar rear wall 12 is well known to those skilled in the art. However, that manner may commonly comprise the use of ultrasonic welding, the use of mutually compatible solvents or adhesives, the use of double-sided adhesive tape, or an adhesive tape overlaid at the contiguous edges, or mixtures thereof.

The embodiment 31 shown in FIG. 11 and 12 is that of a partial conical configuration, in which the translucent front face 14 is configured so as to curve forwardly in such a manner that the radius of curvature of the curved shape at one of the upper and lower edges 38 and 40 is different from the radius of curvature at the other of said upper and lower edges 38 and 40, so as to define a partial, truncated conic enclosed volume forward of said substantially planar rear wall, behind said curved trans lucent front face.

There has been described an electroluminescent supplementary lighting device which has three-dimensional configurations, and several such configurations have been shown in detail. Other amendments to the three-dimensional configurations may be made, without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. An electroluminescent supplementary lighting device having three-dimensional configuration, comprising:

an electroluminescent panel whose construction includes front and back electrically conductive layers with an electroluminescent phosphor layer and a dielectric layer disposed therebetween;

a housing having a substantially planar rear wall through which a pair of electrical prongs protrude for placement into mating slots of an AC power receptacle; and a translucent front face which protrudes forwardly away from said substantially planar rear wall so as to define an enclosed volume between said substantially planar rear wall and said front face;

wherein said electrical prongs extend through said substantially planar rear wall and into said enclosed volume;

wherein said electroluminescent panel has a predetermined shape, and wherein at least one electrical connection to each of said front and back electrically conductive layers is made;

wherein electrically conductive leads extend away from said electrical connection for each of said front and back electrically conductive layers, and said electrically conductive leads have sufficient length and flexibility so that they extend into said enclosed volume for electrical connection to said electrical prongs within said enclosed volume;

wherein said translucent front face has edges thereof which terminate at the edges of said substantially planar rear wall, and wherein adjacent edges of said translucent front face and of said substantially planar rear wall are attached one to the other;

wherein said electroluminescent panel is configured so that at least said one side edge is placed in the region where an edge of said translucent front face is attached to an edge of said substantially planar rear wall; and wherein said electroluminescent panel protrudes forwardly away from said at least one side edge so as to be contiguous to at least a major portion of said translucent front face.

2. The electroluminescent supplementary lighting device having three-dimensional configuration of claim 1, wherein said translucent front face is configured so as to curve forwardly from a pair of opposed side edges of said substantially planar rear wall, so as to define said enclosed volume to be forward of said substantially planar rear wall, behind said curved translucent front face and between upper and lower edges thereof;

wherein said substantially planar rear wall has four side edges to which said translucent face can be respectively attached; and wherein said electroluminescent panel is configured as a partial cylinder by arching a rectangular two-dimensional panel so that two opposed sides of said electroluminescent panel form an arch which corresponds to the arch of said curved translucent front face.

3. The electroluminescent supplementary lighting device having three-dimensional configuration of claim 2, wherein upper and lower faces extend rearwardly from said upper and lower edges of said curved translucent front face to said substantially planar rear wall, and said upper and lower faces each comprise an electroluminescent panel.

4. The electroluminescent supplementary lighting device having three-dimensional configuration of claim 2, wherein said translucent front face is configured so as to curve forwardly such that the radius of curvature of the curved shape at one of said upper and lower edges is different from the radius of curvature at the other of said upper and lower edges, so as to define a partial, truncated conic enclosed volume forward of said substantially planar rear wall, behind said curved translucent front face; and wherein said substantially planar rear wall has four side edges which form a trapezoid to which said translucent face is attached.

5. The electroluminescent supplementary lighting device having three-dimensional configuration of claim 4, wherein one of said surfaces of each of said translucent front face and of said electroluminescent panel is square.

6. The electroluminescent supplementary lighting device having three-dimensional configuration of claim 1, wherein said translucent face has a configuration of a truncated pyramid, comprising a rectangular top surface and four side surfaces sloping downwardly therefrom;

wherein said substantially planar rear wall has four side edges to which said translucent face can be respectively attached;

wherein said electroluminescent panel is configured as a truncated pyramid comprising a rectangular top surface and four side surfaces sloping downwardly therefrom, such that each of said side surfaces have a trapezoidal shape;

wherein each of side surfaces of said electroluminescent panel is separated from the adjacent ones of said side surfaces;

wherein the top edges of each of said side surfaces are contiguous to and electrically connected with said rectangular top surface at the respective front and back electrically conductive layers of each; and wherein said electroluminescent panel is disposed so as to nestle within the enclosed volume between said translucent face and said substantially planar rear wall so that each of said side surfaces of said translucent face rests adjacent and above a corresponding one of said side surfaces of said electroluminescent panel.

7. The electroluminescent supplementary lighting device having three-dimensional configuration of claim 1, wherein said connection to each of said front and back electrically conductive layers is made at said at least one side edge by connectors chosen from the group consisting of a pair of staples connected one to each of said respective electrically conductive layers, a pair of electrically conductive terminal pads secured one to each of said respective electrically conductive layers, and a pair of electrically conductive clips attached one to each of said respective electrically conductive layers; and wherein a pair of wires extends from said connectors into said enclosed volume through which an electrical connection is made between each of said connectors and a respective one of said electrical prongs.

8. The electroluminescent supplementary lighting device having three-dimensional configuration of claim 1, wherein a connection tab extends from said at least one side edge;

wherein said connection tab includes electrically conductive extensions of each of said front and back electrically conductive layers;

wherein a pair of connection terminals extends away from said connection tab, one for each of said front and back electrically conductive layers, and is electrically insulated one from the other;

wherein an electrical connection is made between each of said connection terminals and a respective one of said electrical prongs; and wherein said connection tab is folded from said at least one side edge of said electroluminescent panel so as to extend therebehind into said enclosed volume.

9. The electroluminescent supplementary lighting device having three-dimensional configuration of claim 1, wherein the size of said electroluminescent panel is such that said electroluminescent panel will fit snugly to the interior surface of said translucent front face.

10. The electroluminescent supplementary lighting device having three-dimensional configuration of claim 1, wherein said side edges of said translucent face are attached to said side edges of said substantially planar rear wall by sealing means chosen from the group consisting of ultrasonic welding, mutually compatible solvents, adhesives, double-sided adhesive tapes, overlaid adhesive tapes, snapping adjacent edges together, and mixtures thereof.

11. An electroluminescent supplementary lighting device having three-dimensional configuration, comprising:

an electroluminescent panel whose construction includes front and back electrically conductive layers with an electroluminescent phosphor layer and a dielectric layer disposed therebetween;

a housing having a substantially planar rear wall through which a pair of electrical prongs protrude for placement into mating slots of an AC power receptacle; and a translucent front face which protrudes forwardly away from said substantially planar rear wall so as to define an enclosed volume between said substantially planar rear wall and said front face;

wherein said electrical prongs extend through said substantially planar rear wall and into said enclosed volume;

wherein said electroluminescent panel has a predetermined shape, and wherein at least one electrical connection to each of said front and back electrically conductive layers is made;

wherein electrically conductive leads extend away from said electrical connection for each of said front and back electrically conductive layers, and said electrically conductive leads have sufficient length and flexibility so that they extend into said enclosed volume for electrical connection to said electrical prongs within said enclosed volume;

wherein said translucent front face has edges thereof which terminate at said substantially planar rear wall, and wherein adjacent edges of said translucent front face and of said substantially rear wall are attached one to the other;

wherein said electroluminescent panel is configured so that at least said one side edge is placed in the region where an edge of said translucent front face is attached to an edge of said substantially planar rear wall; and wherein said electroluminescent panel protrudes forwardly away from said at least one side edge so as to be contiguous to at least a major portion of said translucent front face.

12. The electroluminescent supplementary lighting device having three-dimensional configuration of claim 11, wherein said translucent front face is configured so as to curve forwardly from a pair of opposed side edges of said substantially planar rear wall, so as to define said enclosed volume to be forward of said substantially planar rear wall, behind said curved translucent front face and between upper and lower edges thereof;

wherein said substantially planar rear wall has four side edges to which said translucent face can be respectively attached; and wherein said electroluminescent panel is configured as a partial cylinder by arching a rectangular two-dimensional panel so that two opposed sides of said electroluminescent panel form an arch which corresponds to the arch of said curved translucent front face.

13. The electroluminescent supplementary lighting device having three-dimensional configuration of claim 12, wherein upper and lower faces extend rearwardly from said upper and lower edges of said curved translucent front face to said substantially planar rear wall, and said upper and lower faces each comprise an electroluminescent panel.

14. The electroluminescent supplementary lighting device having three-dimensional configuration of claim 12, wherein said translucent front face is configured so as to curve forwardly such that the radius of curvature of the curved shape at one of said upper and lower edges is different from the radius of curvature at the other of said upper and lower edges, so as to define a partial, truncated conic enclosed volume forward of said substantially planar rear wall, behind said curved translucent front face; and wherein said substantially planar rear wall has four side edges which form a trapezoid to which said translucent face is attached.

15. The electroluminescent supplementary lighting device having three-dimensional configuration of claim 14, wherein one of said surfaces of each of said translucent front face and of said electroluminescent panel is square.

16. The electroluminescent supplementary lighting device having three-dimensional configuration of claim 11, wherein said translucent face has a configuration of a truncated pyramid, comprising a rectangular top surface and four side surfaces sloping downwardly therefrom;

wherein said substantially planar rear wall has four side edges to which said translucent face can be respectively attached;

wherein said electroluminescent panel is configured as a truncated pyramid comprising a rectangular top surface and four side surfaces sloping downwardly therefrom, such that each of said side surfaces have a trapezoidal shape;

wherein each of side surfaces of said electroluminescent panel is separated from the adjacent ones of said side surfaces;

wherein the top edges of each of said side surfaces are contiguous to and electrically connected with said rectangular top surface at the respective front and back electrically conductive layers of each; and wherein said electroluminescent panel is disposed so as to nestle within the enclosed volume between said translucent face and said substantially planar rear wall so that each of said side surfaces of said translucent face rests adjacent and above a corresponding one of said side surfaces of said electroluminescent panel.

17. The electroluminescent supplementary lighting device having three-dimensional configuration of claim 11, wherein said connection to each of said front and back electrically conductive layers is made at said at least one side edge by connectors chosen from the group consisting of a pair of staples connected one to each of said respective electrically conductive layers, a pair of electrically conductive terminal pads secured one to each of said respective electrically conductive layers, and a pair of electrically conductive clips attached one to each of said respective electrically conductive layers; and wherein a pair of wires extends from said connectors into said enclosed volume through which an electrical connection is made between each of said connectors and a respective one of said electrical prongs.

18. The electroluminescent supplementary lighting device having three-dimensional configuration of claim 11, wherein a connection tab extends from said at least one side edge;

wherein said connection tab includes electrically conductive extensions of each of said front and back electrically conductive layers;

wherein a pair of connection terminals extends away from said connection tab, one for each of said front and back electrically conductive layers, and is electrically insulated one from the other;

wherein an electrical connection is made at least indirectly between each of said connection terminals and a respective one of said electrical prongs; and wherein said connection tab is folded from said at least one side edge of said electroluminescent panel so as to extend therebehind into said enclosed volume.

19. The electroluminescent supplementary lighting device having three-dimensional configuration of claim 11, wherein the size of said electroluminescent panel is such that said electroluminescent panel will fit snugly to the interior surface of said translucent front face.

20. The electroluminescent supplementary lighting device having three-dimensional configuration of claim 11, wherein said side edges of said translucent face are attached to said side edges of said substantially planar rear wall by sealing means chosen from the group consisting of ultrasonic welding, mutually compatible solvents, adhesives, double-sided adhesive tapes, overlaid adhesive tapes, snapping adjacent edges together, and mixtures thereof.

* * * * *